United States Patent [19]

Messersmith

[11] 4,300,456

[45] Nov. 17, 1981

[54] AUGER-FED SAWDUST BURNER WITH REVOLVING HOPPER

[76] Inventor: Gailyn Messersmith, Rte. #1, Box 38-B, Gourley, Mich. 49812

[21] Appl. No.: 165,406

[22] Filed: Jul. 2, 1980

[51] Int. Cl.[3] ..... F23K 3/00

[52] U.S. Cl. ..... 110/102; 110/110; 198/616

[58] Field of Search ..... 110/102, 108, 110; 198/616, 548, 558; 414/301, 319, 326

[56] References Cited

U.S. PATENT DOCUMENTS

| | | | |
|---|---|---|---|
| 1,767,248 | 6/1930 | Leach | 198/616 X |
| 3,117,681 | 1/1964 | Seymour | 198/616 X |
| 3,279,592 | 10/1966 | Kerkvliet | 198/616 X |

*Primary Examiner*—Edward G. Favors

*Attorney, Agent, or Firm*—Robert G. Mentag

[57] ABSTRACT

A furnace for burning particulate fuels, such as sawdust and the like, and which includes a rotating auger mounted in a rotating cylindrical hopper for feeding the sawdust to a sawdust burner. The hopper is rotatably mounted in a position adjacent a sawdust burner which is located in a housing to form a furnace enclosure. The auger is rotatably mounted in a fixedly mounted conveyor tube which is axially mounted through the hopper. Power means is provided for rotating the auger and the hopper. The hopper has an opening enclosed by a door for inserting sawdust. The hopper has paddles for agitating the sawdust and dropping it onto an open upper side of the auger which then conveys it onto a burner plate in the furnace enclosure which receives induced air for combustion purposes.

9 Claims, 4 Drawing Figures

AUGER-FED SAWDUST BURNER WITH REVOLVING HOPPER

BACKGROUND OF THE INVENTION

1. Field of the Invention

This invention relates generally to furnaces, and more particularly, to a novel and improved furnace for burning particulate fuels such as wood sander dust, sawdust and the like. This invention is specifically concerned with a particulate burner furnace which includes an auger means for feeding fuel, and wherein the auger means is mounted in a revolving hopper.

2. Description of the Prior Art

It is well known in the furnace art to provide furnaces for burning particulate waste material such as wood sander dust, sawdust, wood chips and the like. Some of the prior art furnaces of this type employ funnel shaped hoppers wherein the particulate fuel is fed by gravity to a burner. Such gravity-fed burners are disadvantageous in that the particulate fuel hangs up on the side of the hopper, and when the fuel in the middle of the hopper is exhausted, smoke fills the hopper and leaks into the building in which the burner is employed, and in other cases, the fire in the burner may go out. Also it has been found that sawdust or other particulate fuel falling from the hopper functions to damper the fire in the burner temporarily, which causes loss of the heat and creates creosote in the burner chimney. It is also known to use screw conveyors for feeding particulate fuel to a burner. A disadvantage of such screw conveyors is that the sawdust or other particulate fuel becomes packed in the conveyor or auger until it becomes rock hard and dams up the conveyor. Examples of the aforementioned art particulate fuel burners are illustrated in U.S. Pat. Nos. 307,552; 1,804,285; 2,165,802; 3,610,182; 3,824,937; 3,865,053; 4,096,808; and 4,168,915.

SUMMARY OF THE INVENTION

In accordance with the present invention, an elongated auger is rotatably mounted in a fixedly supported, horizontally disposed conveyor tube. A cylindrical hopper is axially and rotatably mounted on the fixedly mounted conveyor tube. Power means is operatively connected to the auger and the hopper for rotating the auger and the hopper. One end of the fixed conveyor tube and one end of the auger extend outwardly of the hopper and into a furnace enclosure in which is mounted a burner plate. The hopper is provided with a door which may be opened and closed, and locked in a closed position, and through which sawdust or other particulate fuel may be inserted. As the hopper rotates, the sawdust within the hopper is agitated by means of a plurality of paddles carried on the inside of the hopper, and the sawdust is carried upwardly and dropped into an open portion of the conveyor tube and onto the auger, from where it is conveyed through the conveyor tube to the burner plate in the furnace enclosure. An induced air fan is attached to the furnace enclosure for supplying forced draft combustion air through holes formed through the burner plate.

The elongated auger and hopper allow the sawdust or other particulate fuel to be fed to the burner plate in a steady manner to provide an even heat, and prevent creosote build-up in the furnace chimney. The remote position of the burner plate away from the hopper allows the use of green or dry sawdust, and it eliminates smoke leakage into the house in which the furnace is used. In one embodiment, the power means for the auger and the hopper includes a chain drive means operated by a double shaft reduction loader which is provided with suitable rheostat controls to change the speed of the auger to allow for various kinds of sawdust.

DESCRIPTION OF THE PREFERRED EMBODIMENT

Figure 1:
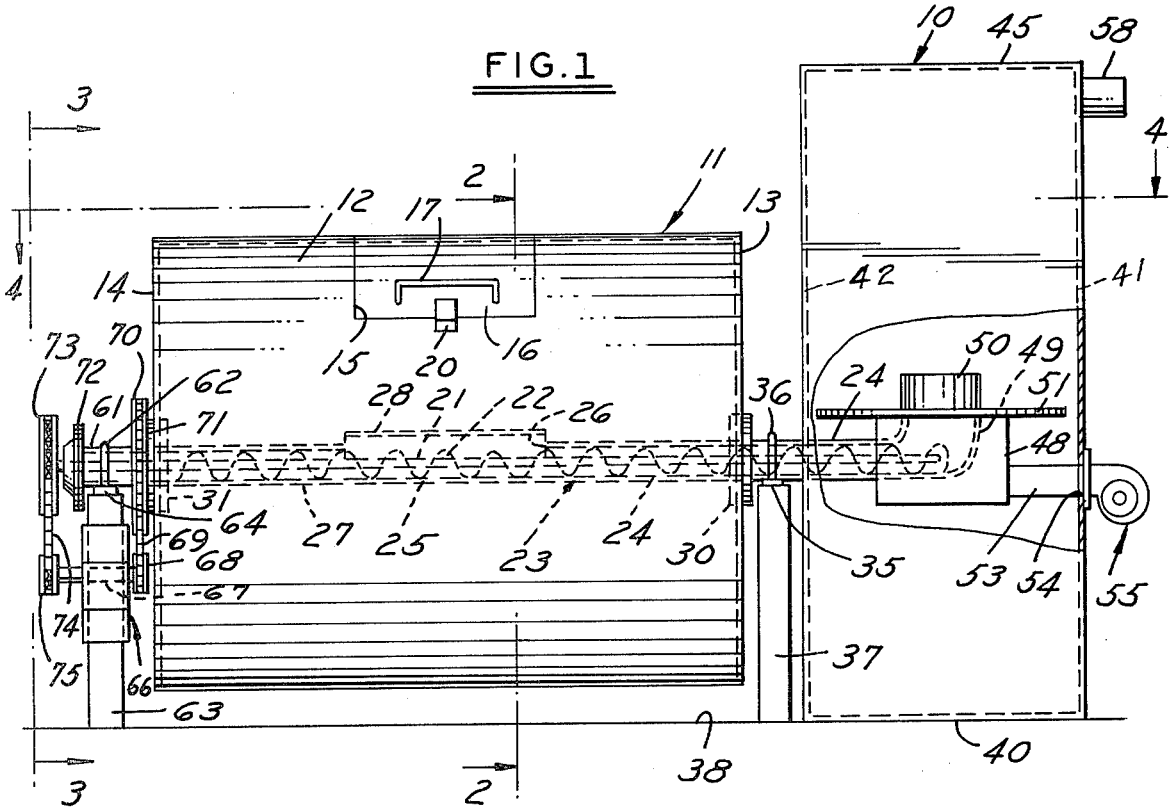
FIG. 1 is a side elevation view, with parts broken away, of an auger-fed sawdust burner with revolving hopper made in accordance with the principles of the present invention.

Referring now to the drawings, and in particular, to FIG. 1, the numeral 10 generally designates a sawdust burning furnace employed in the invention. The numeral 11 generally designates a hopper means employed in carrying out the principles of the invention.

As shown in FIGS. 1 through 4, the hopper 11 includes an elongated, cylindrical body 12 which is enclosed at the front end thereof by a circular end wall plate 13, and at the rear end thereof by a circular end wall plate 14. The end wall plates 13 and 14 are fixedly secured to the hopper body 12 by any suitable means, as by welding.

Figure 2:
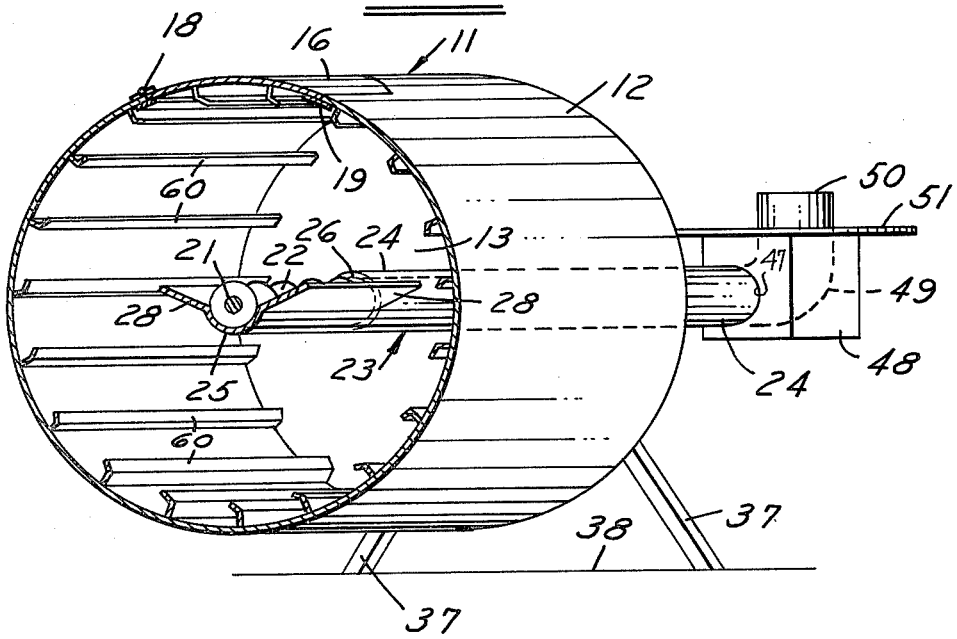
FIG. 2 is an elevation perspective view, partly in section, of the structure illustrated in FIG. 1, taken substantially along the line 2—2 thereof, and looking in the direction of the arrows.
Figure 3:
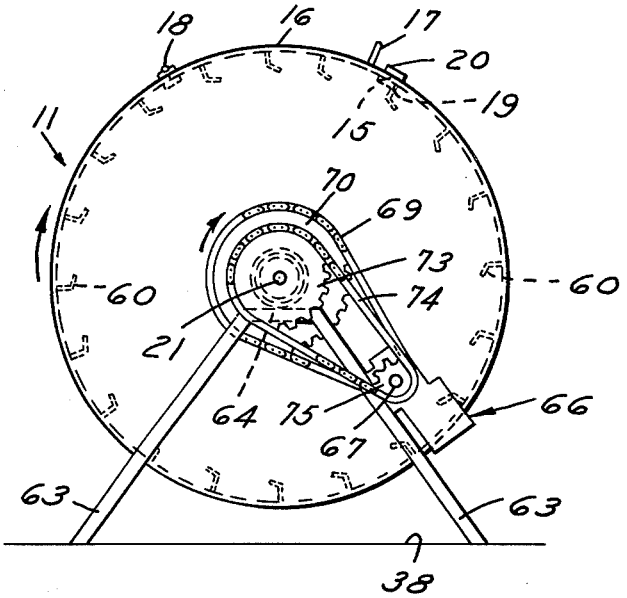
FIG. 3 is a left end elevation view, with parts not shown, of the structure illustrated in FIG. 1, taken along the line 3—3 thereof, and looking in the direction of the arrows.
Figure 4:
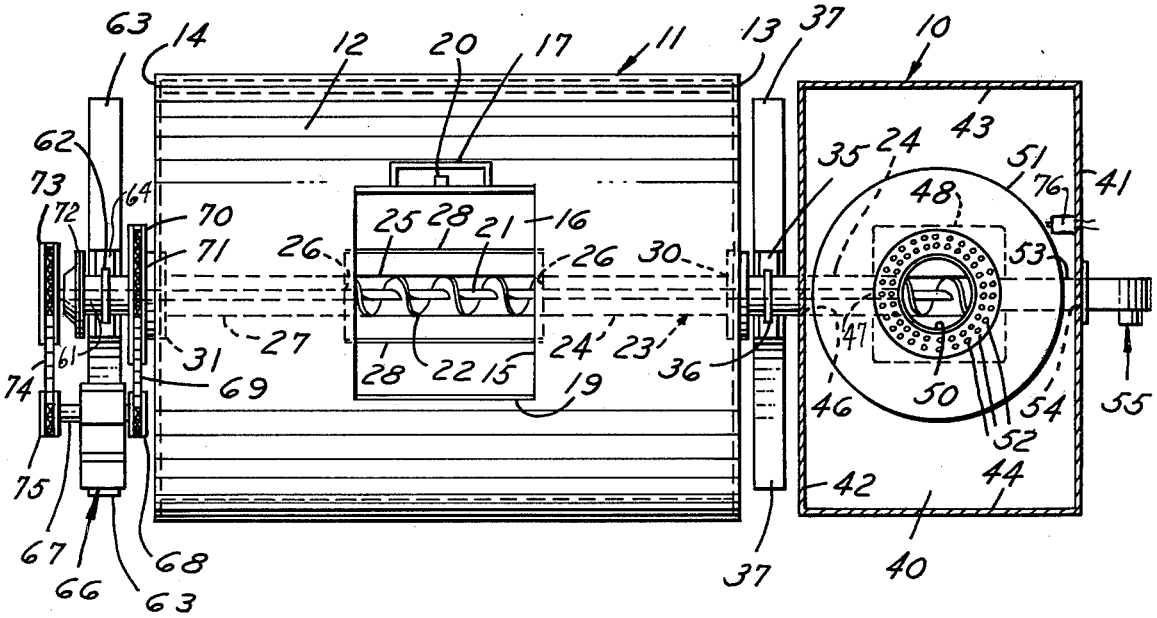
FIG. 4 is a top plan view, partly in section, of the structure illustrated in FIG. 1, and looking in the direction of the arrows.

As best seen in FIG. 4, the hopper body 12 is provided with an arcuate, peripheral opening 15 which is enclosed by a suitable door 16. As shown in FIGS. 1 3 and 4 the door 16 is provided with a suitable handle 17. One end of the door 16 is hingedly attached to the hopper body 12 by a suitable hinge means 18 (FIGS. 1, 2 and 3). The other end of the door 16 is seated on a stop plate 19 which is fixedly secured to the inner surface of the hopper body 12 by any suitable means, as by welding. The door 16 is adapted to be releasably secured in the closed position shown in FIGS. 1 through 4 by a suitable latch means 20.

As shown in FIGS. 1, 2 and 3, the auger means employed in the invention includes an elongated horizontal shaft 21 on which is fixedly mounted an auger or screw 22. As best seen in FIG. 1, the auger 22 extends for the full length of the hopper 11 and into the furnace 10. The auger 22 is rotatably mounted in an elongated sawdust feed tube, generally indicated by the numeral 23, and which is axially mounted in the cylindrical hopper 11. As shown in FIGS. 1 and 4, the front end portion 24 of the feed tube 23 extends through the front end wall 13 of the hopper 11 and into the furnace 10. As best seen in FIG. 1, the sawdust feed tube 23 includes an integral half-round portion 25 which is integrally connected at its front end to the feed tube front end portion 24, and at its rear end to the feed tube rear end portion 25. The front and rear ends of the half-round feed tube portion 25 are indicated by the numerals 26 in FIG. 4. The half-round feed tube portion 25 is open upwardly, and it is integrally connected at the outer ends thereof to a pair of upwardly sloping sawdust catcher plates 28.

As shown in FIGS. 1 and 4, the front end of the hopper 11 is rotatably mounted by a suitable hopper bearing 30, on the sawdust feed tube front portion 24. The rear end of the hopper 11 is similarly rotatably mounted, by a suitable bearing 31, on the sawdust feed tube rear portion 27.

As shown in FIGS. 1 and 4, the sawdust feed tube front portion 24 is supported at a point between the front end of the hopper 11 and the rear end of the furnace 10 by a horizontal support bar 35. The horizontal support bar 35 is fixedly attached at its outer ends by any suitable means, as by welding, to the upper end of a pair of outwardly and downwardly disposed angular support legs 37. The lower ends of the support legs 37 are adapted to stand on a supporting surface 38, as for example, the floor of a building. The sawdust feed tube front portion 24 is fixedly secured to the horizontal support bar 35 by a suitable U-shaped attachment bolt 36 which is fixed to the horizontal support bar 35 by any suitable means, as by suitable bolts and nuts (not shown) or by welding.

As shown in FIG. 4, the furnace 10 includes a bottom end wall 40, a front end vertical wall 41, and a rear end vertical wall 42. The furnace 10 further includes a pair of laterally spaced apart side walls 43 and 44. As shown in FIG. 1, the furnace 10 also includes a top end wall 45. The furnace walls 40 through 45 are fixedly secured together in a conventional manner, as by welding.

As shown in FIG. 4, the feed tube front portion 24 extends forwardly between the furnace 10 and through an opening 46 in the furnace side wall 42. The conveyor or tube 24 is sealed in the opening 46 by any suitable means to prevent flow of gasses from passing outwardly through the opening 46. As shown in FIG. 4, the burner plate 51 is provided with a plurality of holes which are disposed around the vertical tube portion 50. The vertical tube portion 50 is open at the upper end so that the sawdust conveyed by the auger 22 into the lower end of the elbow 49 is forced upwardly and out of the elbow portion 50, and onto the upper side of the burner plate 51.

As shown in FIGS. 1 and 4, combustion air is forced into the air box 48 by means of a suitable induced draft fan, generally indicated by the numeral 55. The forced draft fan 55 is operatively connected to an air conduit 53 which extends into the furnace through an opening 54 that is formed through the furnace front end wall 41. The inner end of the air conduit 53 is connected to the air box 48. As shown in FIG. 1, the furnace 10 is provided with the usual flue means 58 for conveying the combustion gases to a chimney.

As best seen in FIGS. 2 and 3, the hopper 11 is provided with a plurality of paddles 60 which are fixedly mounted on the inner side of the circular wall of the hopper 11, in longitudinally disposed, and evenly spaced apart positions. The paddles 60 are substantially L-shaped in cross section, so that when the hopper 11 is rotated in a clockwise direction, as viewed in FIG. 3, the paddles 60 loosen the sawdust in the hopper 11 and they each lift a portion of sawdust upwardly and over the open portion of the auger 22, so that sawdust drops downwardly onto the angled catcher plates 28 and slides downwardly through the opening 26 in the tube 23 and onto the auger 22 for conveyance through feed tube 23 to the burner plate 51.

As shown in FIGS. 1 and 4, the rear end portion of the sawdust feeder conveyor or feed tube extends axially out through the rear end wall 14 of the hopper 11, and it is indicated by the numeral 61. The rear end portion 61 of said tube is supported by a horizontal support bar 64. The horizontal support bar 64 is fixedly attached at its outer ends by any suitable means, as by welding to the upper end of a pair of outwardly and downwardly disposed angular support legs 63. The lower ends of the support legs 63 are adapted to stand on the supporting surface 38. The feed tube portion 61 is fixedly secured to the horizontal support bar 64 by a suitable U-shaped attachment bolt 62 which is fixed to the horizontal support bar 35 by any suitable means, as by suitable bolts and nuts (not shown), or as by welding.

As shown in FIGS. 1, 3 and 4, the auger 22 and the hopper 11 are rotated by a suitable chain drive means which is powered by a double-ended shaft, combination speed reducer and electric motor, generally indicated by the numeral 66. As shown in FIGS. 3 and 4, one end of the double-ended output shaft 67 of the combination speed reducer and electric drive motor 66 has operatively attached thereto a drive sprocket wheel 68 which drives a sprocket drive chain 69. The sprocket drive chain 69 is operatively mounted around a driven sprocket wheel 70 which is operatively attached to a mounting collar 71 which is fixed to the outer face of the rear end wall 14 of the hopper 11. The other end of the output shaft 67 has fixedly mounted thereon a suitable drive sprocket wheel 75 which drives a sprocket chain 74 that is operatively mounted around a driven sprocket wheel 73. The sprocket wheel 73 is operatively mounted on the rear end of the auger shaft 21 which is supported in a suitable support bearing 72 mounted on the rear end portion 61 of the stationary conveyor or feed tube 23.

As shown in FIG. 4, the furnace 10 is provided with a suitable igniter means 76. It will be understood that any suitable conventional thermostatic control means may be employed for controlling the feed operation of the combination speed reducer and motor 66 and the operation of the igniter means 76.

It will also be understood that the combination speed reducer and electric motor 66 is provided with a suitable rheostat control for changing the speed of the auger 22 for feeding various kinds of sawdust or other particulate fuel.

In operation, the rotation of the hopper 11 moves the paddles 60 upwardly and over the auger means 22, whereby the sawdust is not only loosened in the hopper, but some of it is moved upwardly and over the auger 22 and dropped by gravity onto the auger 22 and onto the sawdust catcher plates 28 for gravity flow downwardly through the opening 26 in the feed tube 23. The rotating auger 22 moves in a clockwise direction, as viewed from the end thereof in FIG. 3, so as to convey the sawdust to the right, as shown in FIG. 4, through the conveyor tube 23 and through the elbow 49 and up through the outlet 50 and onto the burner plate 51. A force draft of combustion air is fed into the air box 48 and up through the holes 52, and into the sawdust on the burner plate 51 where the sawdust is ignited by the igniter 76. The amount of sawdust fed onto the burner plate 51 is controllable by controlling the speed of the auger 22. The "on" and "off" operation for burning the sawdust is controlled by any suitable thermostatic control means.

While it will be apparent that the preferred embodiments of the invention herein disclosed are well calculated to fulfill the objects above stated, it will be appreciated that the invention is susceptible to modification, variation and change.

What is claimed is:

1. An apparatus for burning particulate fuel comprising:
   (a) a furnace means for burning particulate fuel;
   (b) a particulate fuel hopper;
   (c) means for rotatably mounting said particulate fuel hopper;
   (d) auger means for conveying particulate fuel from the hopper into said furnace means;
   (e) power means for rotating said particulate fuel hopper and said auger means; and,
   (f) said means for rotatably mounting said particulate fuel hopper including:
   (1) a horizontally disposed, elongated conveyor tube for conveying particulate fuel into said furnace means;
   (2) means for fixedly supporting said conveyor tube on a supporting surface; and,
   (3) bearing means for rotatably mounting said particulate fuel hopper on the conveyor tube.

2. An apparatus for burning particulate fuel as defined in claim 1, wherein:
   (a) said auger means is rotatably mounted in said conveyor tube.

3. An apparatus for burning particulate fuel as defined in claim 2, wherein said power means for rotating said particulate fuel hopper in said auger means includes:
   (a) a drive motor means;
   (b) a first drive train means operatively connected between said drive motor means and said hopper for rotating the hopper; and,
   (c) a second drive train means operatively connected between said drive motor means and said auger means for rotating the same.

4. An apparatus for burning particulate fuel as defined in claim 3, wherein:
   (a) each of said first and second drive train means comprises a sprocket chain and sprocket wheel drive means.

5. An apparatus for burning particulate fuel as defined in claim 4, wherein:
   (a) said elongated conveyor tube is axially disposed through said conveyor and has an opening exposed to the interior of the hopper for receiving particulate fuel for feeding by the auger means to convey the particulate fuel through the conveyor tube to the furnace means.

6. An apparatus for burning particulate fuel as defined in claim 5, wherein:
   (a) said conveyor tube is provided with particulate fuel catcher plates mounted on each side of said opening.

7. An apparatus for burning particulate fuel as defined in claim 6, wherein:
   (a) said hopper is provided with an opening which is enclosed by a swingably mounted door that is releasably locked in a closed position, and which may be opened for inserting particulate fuel into the hopper.

8. An apparatus for burning particulate fuel as defined in claim 7, wherein:
   (a) said hopper is provided with a plurality of interior paddles for agitating the particulate fuel in the hopper and for carrying particulate fuel upwardly and over said conveyor tube opening and to allow the particulate fuel to drop off the paddles and fall by gravity into said conveyor tube opening.

9. An apparatus for burning particulate fuel as defined in claim 5, wherein:
   (a) said conveyor tube and auger means is extended into said furnace means and into operative relationship with a burner plate mounted in the furnace means so as to deposit particulate fuel on the burner plate; and,
   (b) said furnace means includes a fan means for providing a force draft combustion air supply to the burner plate.

* * * * *